US007448229B2

(12) United States Patent
Chin et al.

(10) Patent No.: US 7,448,229 B2
(45) Date of Patent: Nov. 11, 2008

(54) HEAT EXCHANGER OF AIR CONDITIONER

(75) Inventors: Sim Won Chin, Seoul (KR); Dong Soo Moon, Seoul (KR); Hyun Jong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 388 days.

(21) Appl. No.: 11/262,853

(22) Filed: Nov. 1, 2005

(65) Prior Publication Data

US 2006/0168998 A1 Aug. 3, 2006

(30) Foreign Application Priority Data

Jan. 31, 2005 (KR) ..... 2005-0008843

(51) Int. Cl.
*F28F 7/00* (2006.01)

(52) U.S. Cl. ..... 62/515; 62/324.6

(58) Field of Classification Search ..... 62/324.6, 62/515, 525; 165/72, 139
See application file for complete search history.

(56) References Cited

U.S. PATENT DOCUMENTS 6,883,348 B2 * 4/2005 Hong et al. ..... 62/525
6,951,117 B1 * 10/2005 Wightman ..... 62/200
2005/0050910 A1 * 3/2005 Moon et al. ..... 62/324.1

FOREIGN PATENT DOCUMENTS

CN 1148541 C 5/2004
JP 10-176837 6/1998

* cited by examiner

*Primary Examiner*—Melvin Jones
(74) *Attorney, Agent, or Firm*—Birch, Stewart, Kolasch & Birch, LLP

(57) ABSTRACT

A heat exchanger of an air conditioner comprising: at least one or more refrigerant inlets for connecting a compressor for compressing refrigerant to an expansion device for expanding condensed refrigerant via a piping and for receiving high temperature/pressure refrigerant coming from the compressor via a four-way valve; at least one or more refrigerant outlets for discharging the refrigerant to the expansion device, wherein the number of the refrigerant outlets is greater than that of the refrigerant inlets, such that same performances can be achieved for both the cooling and heating purposes albeit the heat exchanger being simplified in the structure thereof, and manufacturing cost can be reduced to thereby improve the productivity.

11 Claims, 9 Drawing Sheets

HEAT EXCHANGER OF AIR CONDITIONER

CROSS-REFERENCE TO RELATED APPLICATION

This application claims the benefit of Korean Application No. 10-2005-0008843, filed on Jan. 31, 2005, in the Korean Intellectual Property Office, the disclosure of which is incorporated herein by reference in its entirety.

BACKGROUND OF THE INVENTION

1. Field

Generally, the present invention relates to a heat exchanger of an air conditioner, and more particularly to a heat exchanger of a cooling and heating air conditioner.

2. Description of the Prior Art

Typically, a heat pump is composed of a compressor, an evaporator, a condenser, an expansion device, and in case of heating, a cycle is repeated where refrigerant is compressed to a high temperature, high pressurized refrigerant by a compressor, which is evaporated, and discharged to a condenser from which a high temperature heat is discharged to outside where temperature is lower. Alternatively, in case of cooling operation mode, a condenser operates as an evaporator and an evaporator functions as a condenser to allow the condensed refrigerant to heat-exchange with the hot outside air.

Referring to FIG. 1, a cooling cycle includes a compressor (COMP) for compressing a low temperature/pressure vaporized refrigerant to a high temperature/pressure vaporized refrigerant, a condenser (COND) for changing the high temperature/pressure vaporized refrigerant changed by the compressor (COMP) to a high temperature/pressure liquefied refrigerant and discharging heat to the outside, an expansion device (EXP) for changing the high temperature/pressure liquefied refrigerant changed by the condenser to a low temperature/pressure two phase refrigerant, and an evaporator (EVA) for changing the low temperature/pressure two phase refrigerant changed by the expansion device (EXP) to vaporized refrigerant and absorbing the outside heat.

In the cooling cycle thus described, a heat pump is configured in such a manner that heating and cooling can be selectively chosen by forwardly or reversely circulating the cooling cycle where heat is absorbed by the evaporator (EVA), and the heat is discharged by the condenser (COND).

Referring to FIG. 2, a heat pump includes a compressor (COMP) for compressing the refrigerant, an outdoor heat exchanger (Hout) connected to the compressor (COMP) via a pipe (P) for functioning as a condenser during cooling mode operation and functioning as an evaporator during heating operation mode, an indoor heat exchanger (Hin) connected to the compressor (COMP) via a pipe (P) for performing a vaporizing process during cooling operation mode and performing a condensing process during heating operation mode, a four-way valve (V) for supplying a high temperature/pressure refrigerant discharged from the compressor (COMP) to the outdoor heat exchanger (Hout) during cooling operation mode and to the indoor heat exchanger (Hin) during heating operation mode, and an expansion device (EXP) mounted at an outdoor side for expanding the condensed refrigerant.

In the heat pump thus configured, the four-way valve (V) sends the high temperature/pressure refrigerant discharged from the compressor (COMP) to the indoor heat exchanger (Hin) or to the outdoor heat exchanger (Hout) to cool or heat the air within a defined space according to the selection of cooling or heating operation mode.

In other words, the four-way valve (V) sends the high temperature/pressure refrigerant discharged from the compressor (COMP) to the outdoor heat exchanger (Hout) side during cooling operation mode, and to the indoor heat exchanger (Hin) side during heating operation mode. The outdoor heat exchanger (Hout) functions as a condenser to cool the high temperature/pressure refrigerant to a condensed liquefied state during cooling operation mode, and the condensed liquefied refrigerant passes an expansion valve (V) and is partially vaporized to move to the indoor heat exchanger (Hin) in a mixed state of gas and liquid.

The refrigerant is vaporized during cooling in the indoor heat exchanger (Hin) to function as an evaporator for cooling the air within a defined space, and the vaporized refrigerant passes the four-way valve (V) to re-enter the compressor (COMP) . Alternatively, in the heating operation mode, the outdoor heat exchanger (Hout) and the indoor heat exchanger (Hin) function in the reverse way such that an evaporating process is carried out in the outdoor heat exchanger (Hout) while the condensing process is conducted in the indoor heat exchanger (Hin).

Referring to FIG. 3, an indoor heat exchanger (Hin) according to the prior art includes a first heat exchange unit (10), a second heat exchange unit (20), a connecting pipe (P1) connecting the first heat exchange unit (10) to the second heat exchange unit (20), and an expansion valve (EXV) disposed at the connecting pipe (P1) for allowing both the first heat exchanger unit (10) and the second heat exchanger unit (20) to perform an evaporating function or a condensing function during cooling and heating operation modes and for allowing the first heat exchanger unit (10) to perform a condensing -function and the second heat exchanger unit (20) to perform an evaporating function during indoor fixed temperature humidity operation.

The first and second heat exchanger units (10.20) all function as an evaporator during cooling operation mode, and the refrigerant discharged from the compressor (COMP) is introduced into the first heat exchanger unit (10) via the outdoor heat exchanger (Hout) and the expansion device (EXP), and the refrigerant introduced into the first heat exchanger unit (10) passes through the opened expansion valve (EXV) to flow into the second heat exchanger unit (20) and to be sucked into the compressor (COMP) along an external pipe (P2) at the second heat exchanger unit (20) side.

During the heating operation mode, the first and second heat exchanger units (10.20) all function as a condenser, and the refrigerant discharged from the compressor (COMP) flows into the second heat exchanger unit (20), and the refrigerant introduced into the second heat exchanger unit (20) passes the opened expansion valve (EXV) to flow into the first heat exchanger unit (10) and again passes the expansion device (EXP) and the outdoor heat exchanger (Hout) along the external pipe (P2) at the first heat exchanger unit (10) to be sucked into the compressor (COMP)

Referring to FIG. 4, the number and position of a refrigerant inlet (11) and a refrigerant outlet (12) at the indoor heat exchanger (Hin) according to the prior art are arbitrarily constructed by a designer to obtain a maximum performance.

The refrigerant is greatly influenced by temperature and pressure depending on the property of gas, and amount of refrigerant varies depending on whether it is a cooling operation or a heating operation mode. As illustrated in FIG. 5, there is a problem in that a check valve (30) should be additionally mounted because a main cooling expansion device (EXP1) and an auxiliary heating expansion device (EXP2), each being different in size, should be respectively equipped for cooling and heating operation modes, wherein the main expansion device (EXP1) is operated during cooling and heating operation modes while the auxiliary expansion device (EXP2) is operated only during heating operation mode.

SUMMARY OF THE INVENTION

The present invention is disclosed to solve the aforementioned problems and it is an object of the present invention to provide a heat exchanger of an air conditioner configured to increase the number of refrigerant inlet more than that of the refrigerant outlet based on the cooling operation mode and to cause an over-cooling end to exist during heating operation mode, whereby the refrigerant quantity can be approximated during the cooling mode and the heating mode to allow one expansion device to be used, thereby enabling to simplify the structure of the heat exchanger and to increase the cooling and heating efficiency thereof.

In accordance with the object of the invention, there is provided a heat exchanger of an air conditioner, comprising: a heat exchanging part having at least one or more refrigerant inlets (hereinafter referred to as inlet heat exchanging parts); at least one or more branch pipes each connected to the refrigerant inlet of the inlet heat exchanging parts for distributing the refrigerant during the cooling operation mode and for concentrating the refrigerant during the heating operation mode; and a heat exchanging part having a plurality of branched refrigerant outlets (hereinafter referred to as branched heat exchanging parts), each one end thereof connected to one end of the branch pipe and each other end formed with the refrigerant outlet.

According to the present invention, the number of the refrigerant outlet is greater than that of the refrigerant inlet based on the cooling operation mode, and the number of refrigerant inlet is smaller than that of the refrigerant outlet based on the heating operation mode, such that an indoor heat exchanger functions as a condenser during cooling operation mode to further increase an over-cooling region, whereby refrigerant quantity is increased and approximated during cooling and heating operation modes, thereby enabling an air conditioner to operate both for cooling and heating operation modes.

The inlet heat exchanging unit, the branch pipes and the branched heat exchanging unit form one heat exchanging unit to function as an indoor heat exchanger or an outdoor heat exchanger. When the heat exchanging unit functions as an indoor heat exchanger, it may form a cooling cycle with other heat exchangers functioning as an outdoor heat exchanger and expansion device. The heat exchanger according to the present invention may comprise a plurality of heat exchanging units formed with the inlet heat exchanging part, branch pipes and the branched heat exchanging part.

The heat exchanger according to the present invention may further comprise an inner expansion valve apart from the overall cooling cycle to form an inner cooling cycle, thereby enabling to perform a defrosting or dehumidifying function.

DETAILED DESCTIPTION OF THE INVENTION

Figure 1:
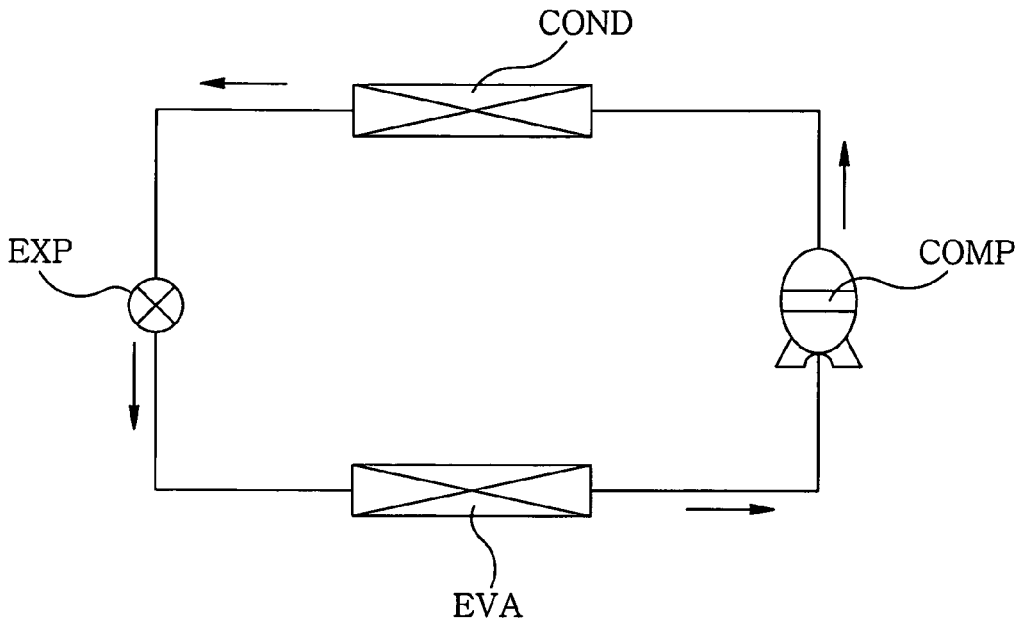
FIG. 1 is a block diagram of an air conditioner according to the prior art.
Figure 2:
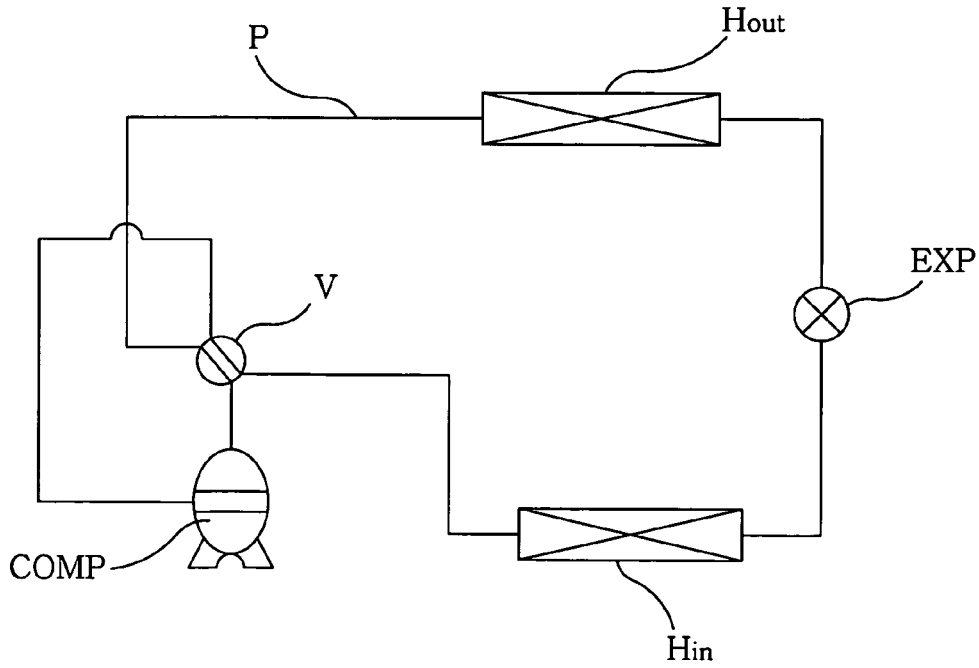
FIG. 2 is a schematic block diagram of cooling/heating air conditioner according to the prior art.
Figure 3:
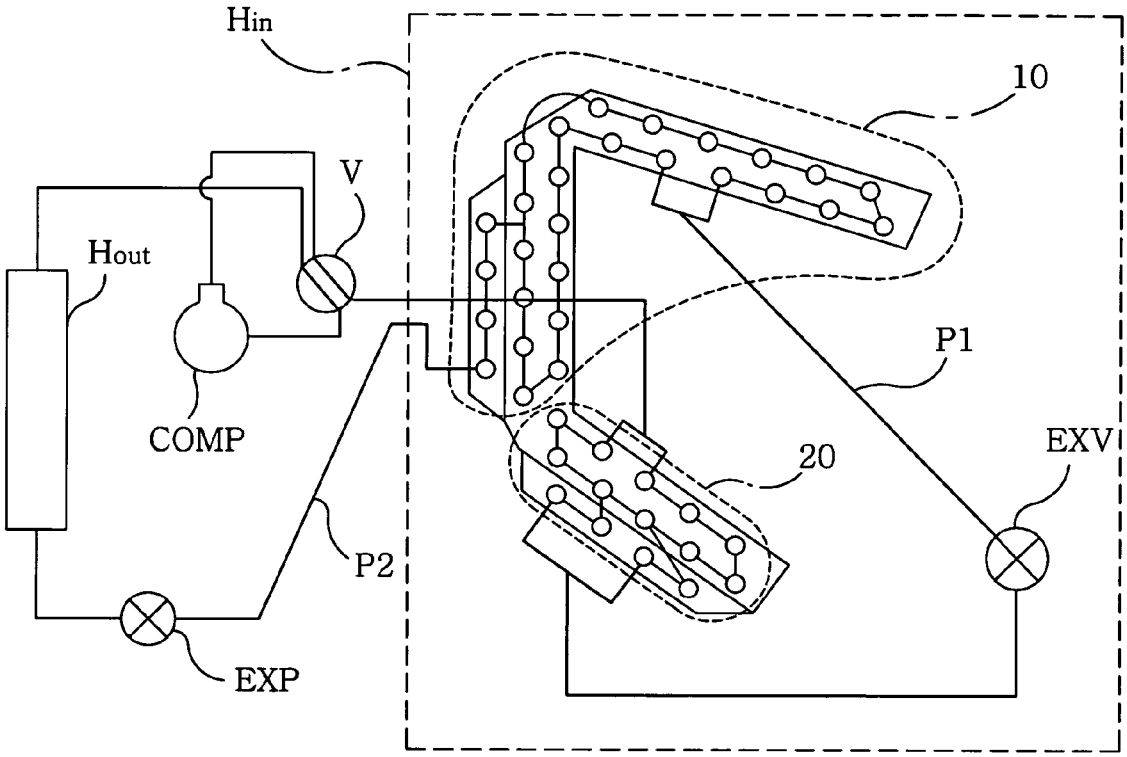
FIG. 3 is a detailed drawing of a cooling/heating air conditioner according to the prior art.
Figure 4:
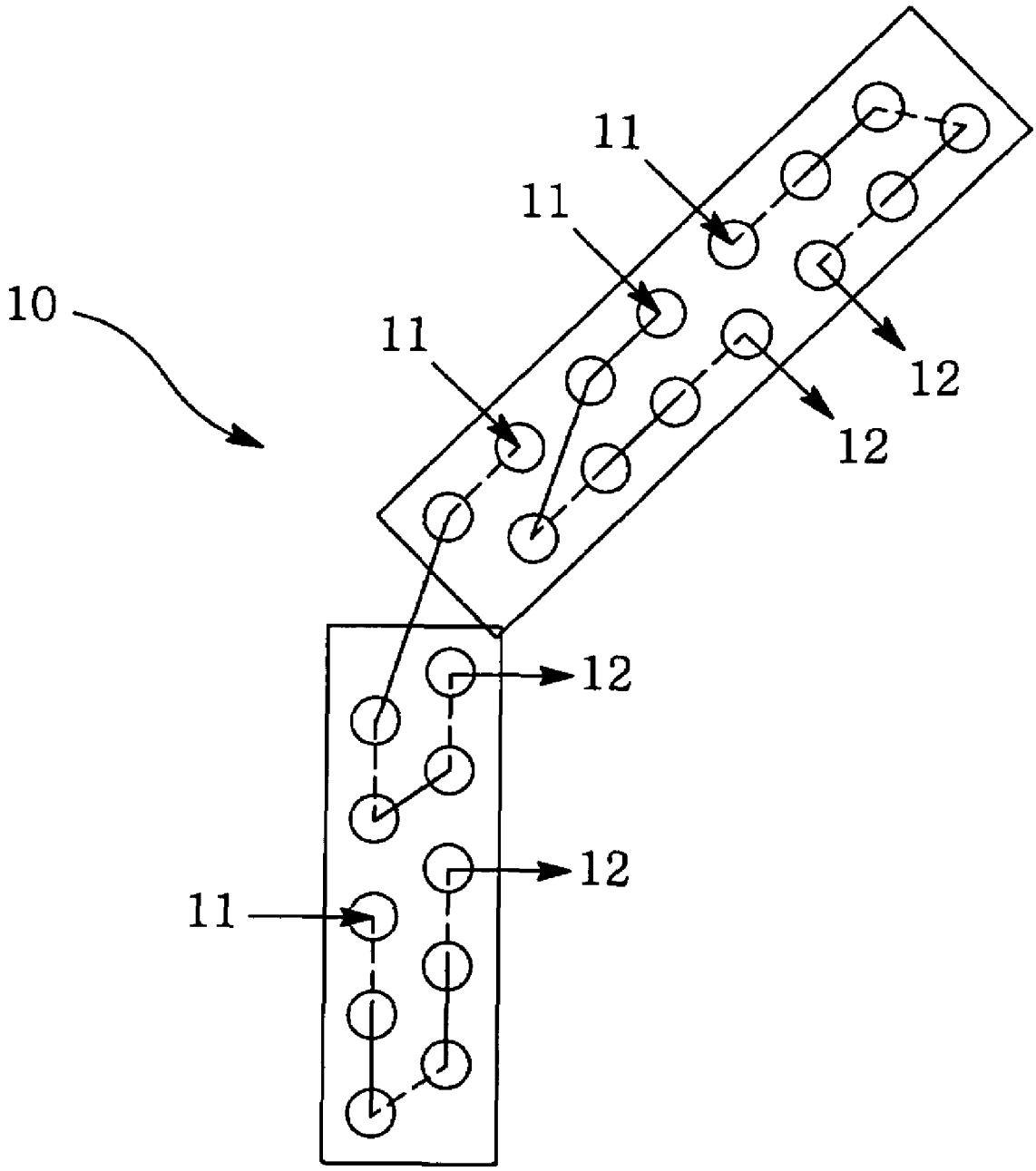
FIG. 4 is a schematic drawing of a heat exchanger of an air conditioner according to the prior art.
Figure 5:
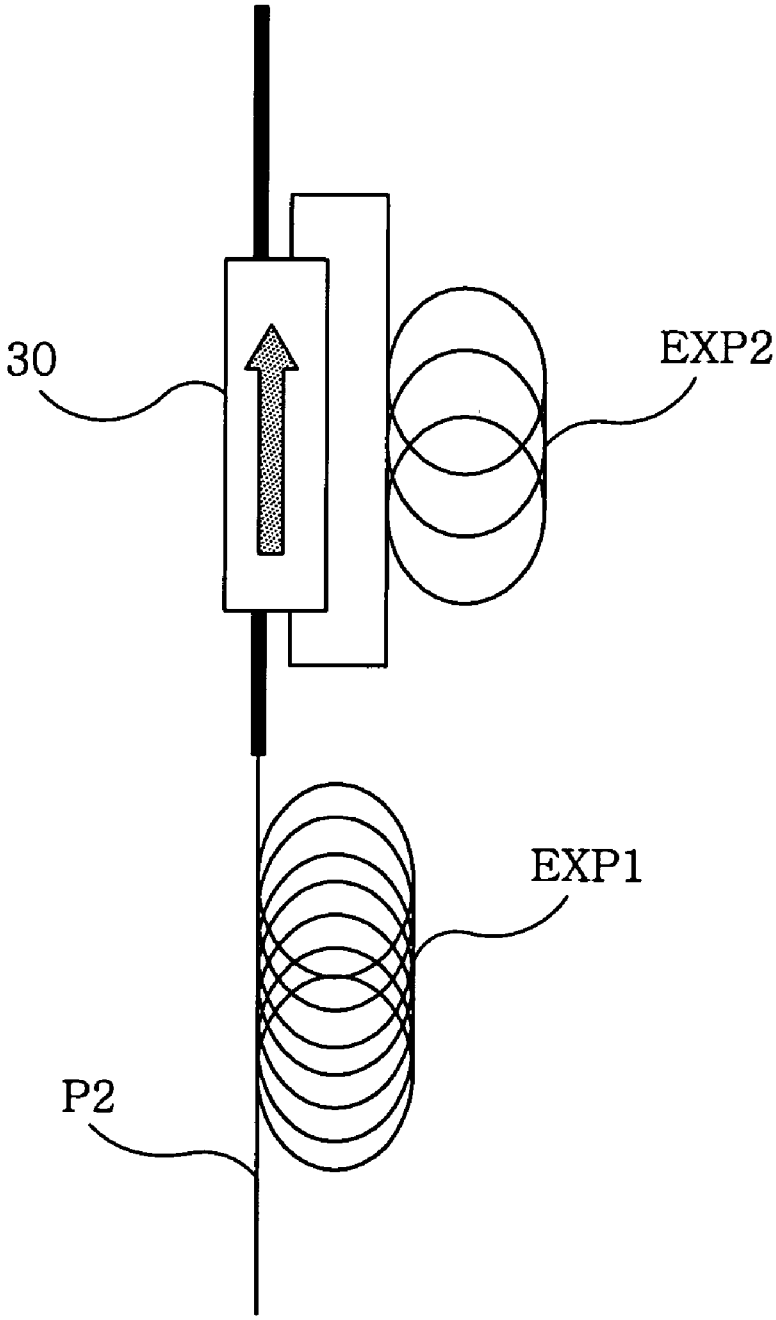
FIG. 5 is a schematic drawing of an expansion device of an air conditioner according to the prior art.
Figure 6:
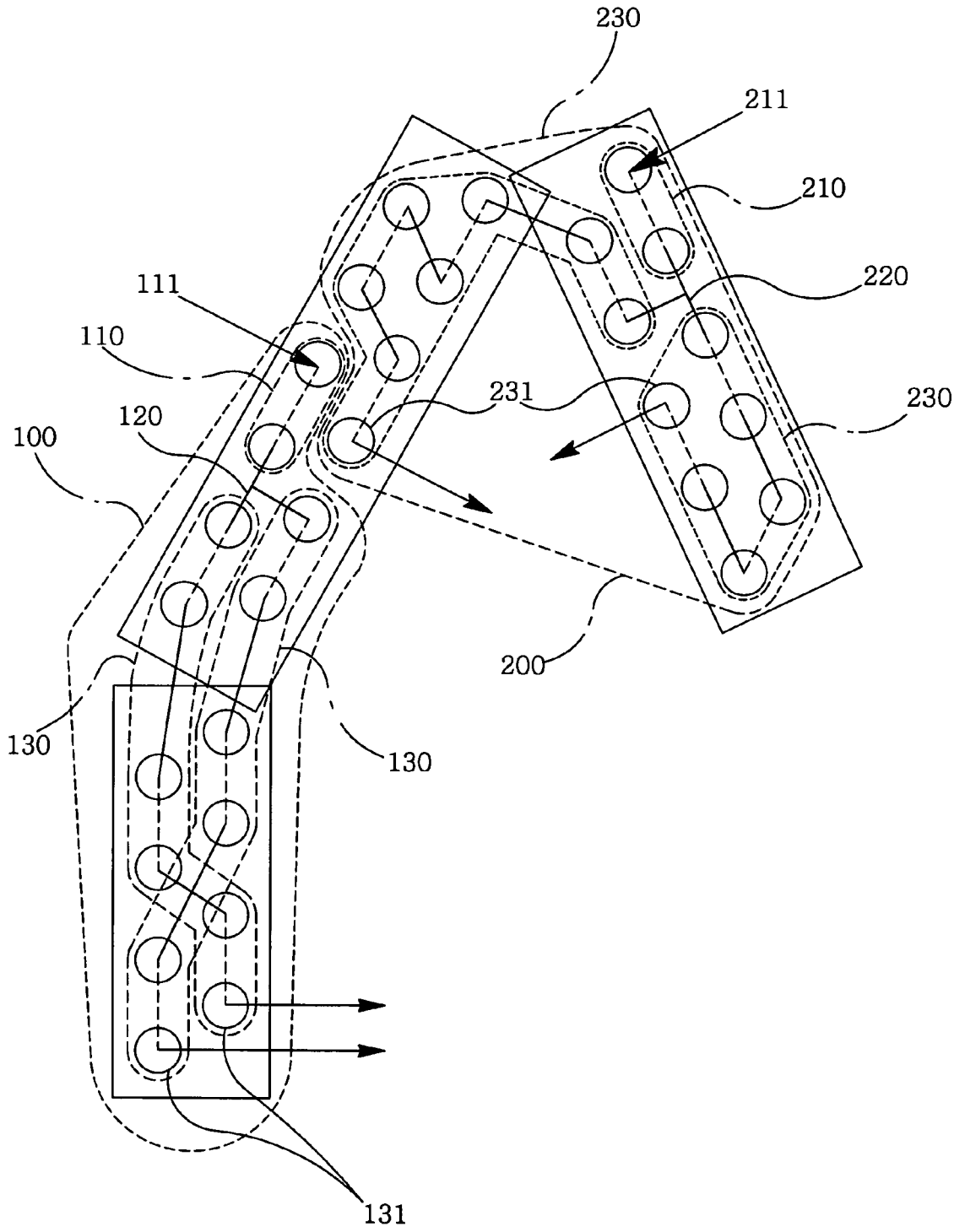
FIG. 6 is a schematic drawing of an embodiment of a heat exchanger of an air conditioner according to the present invention.

Now, preferred embodiments of the present invention will be described with reference to FIGS. 6 to 8.

A heat exchanger according to the present invention is comprised of a first heat exchanging part (100) and a second heat exchanging part (200).

The first heat exchanging part (100) includes a first inlet heat exchanging part(110) singularly disposed with a first refrigerant inlet (111), a first branch pipe (120) connected to the first inlet refrigerant inlet (110) and for dividing the refrigerant during the cooling operation mode and concentrating the refrigerant during the heating operation mode, and a pair of first branched heat exchanging parts (130) respectively connected at one end thereof to one side of the first branch pipe (120) and connected at the other end thereof to a first refrigerant outlet (131).

A second heat exchanging part (200) includes a second inlet heat exchanging part (210) singularly disposed with a second refrigerant inlet (211), a second branch pipe (220) connected to a second inlet heat exchanging part (210) and for dividing the refrigerant during the cooling operation mode and for concentrating the refrigerant during the heating operation mode, and a pair of second branched heat exchanging parts (230) respectively connected at one end thereof to one side of a second branch pipe (220) and connected at the other end thereof to a second refrigerant outlet (231).

The pair of first branched heat exchanging parts (130) is connected in parallel to one side of the first branched heat exchanging part (130) and the pair of second branched heat exchanging parts (230) is connected in parallel to one side of the second branch pipe (220).

The first and second refrigerant inlets (111. 211) are respectively disposed at each distal end of the first inlet heat exchanging part (110) and the second inlet heat exchanging part (210) such that a total number of refrigerant inlets is 2, and the first and second refrigerant outlets (131. 231) are respectively disposed in pairs at the first and second heat exchanging parts (130.230) such that a total number of refrigerant outlets is 4. In other words, the number of refrigerant outlets is larger than the number of refrigerant inlets.

The first and second branch pipes (120. 220) are "T" shaped 3-branched pipes, one end of which is connected to the first and second inlet heat exchanging parts (110.210), and balance two ends of which are connected to first and second branched heat exchanging parts (130.230).

Figure 7:
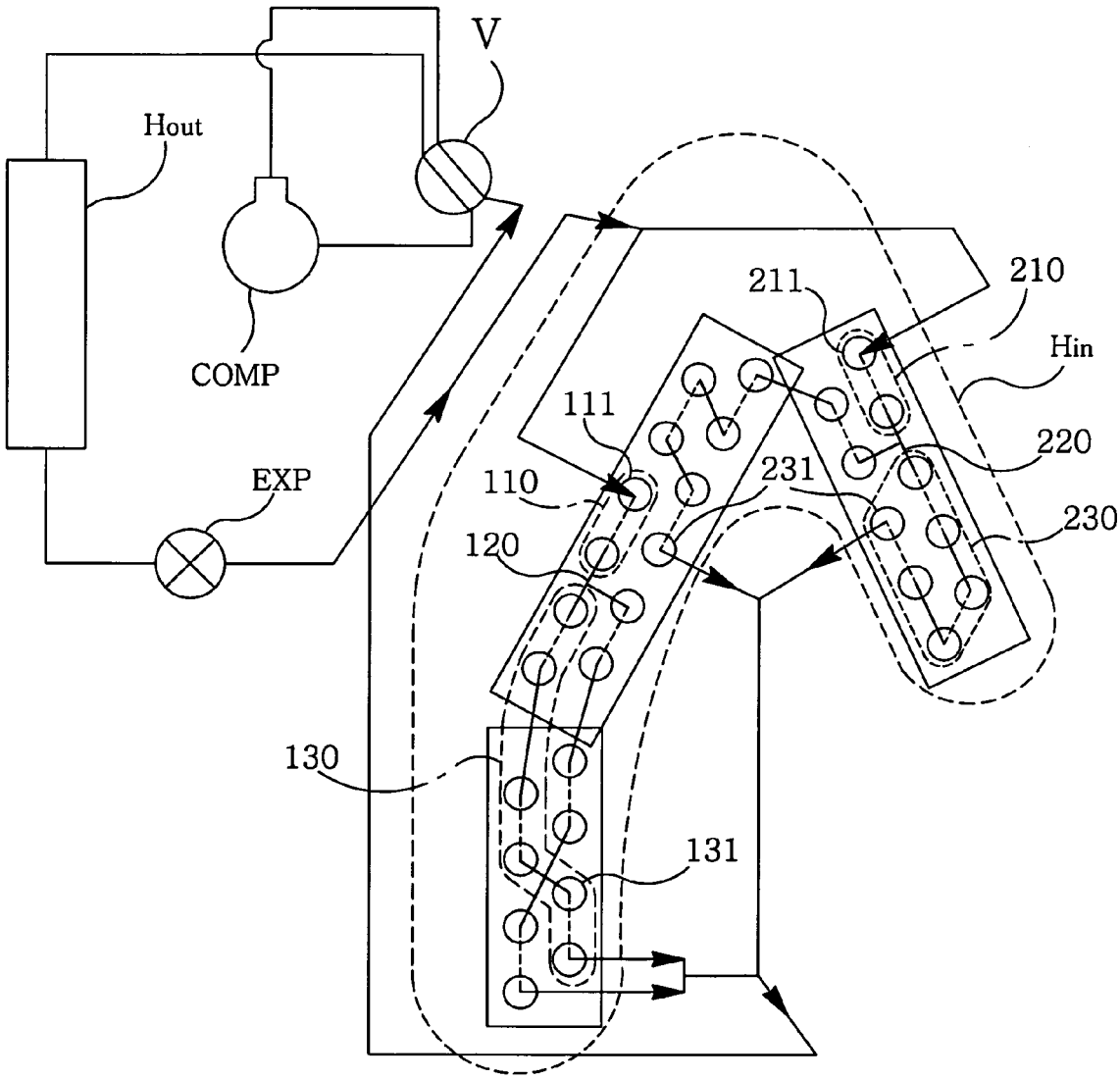
FIG. 7 is a constitutional drawing of an exemplary use of an embodiment of the present invention.
Figure 8:
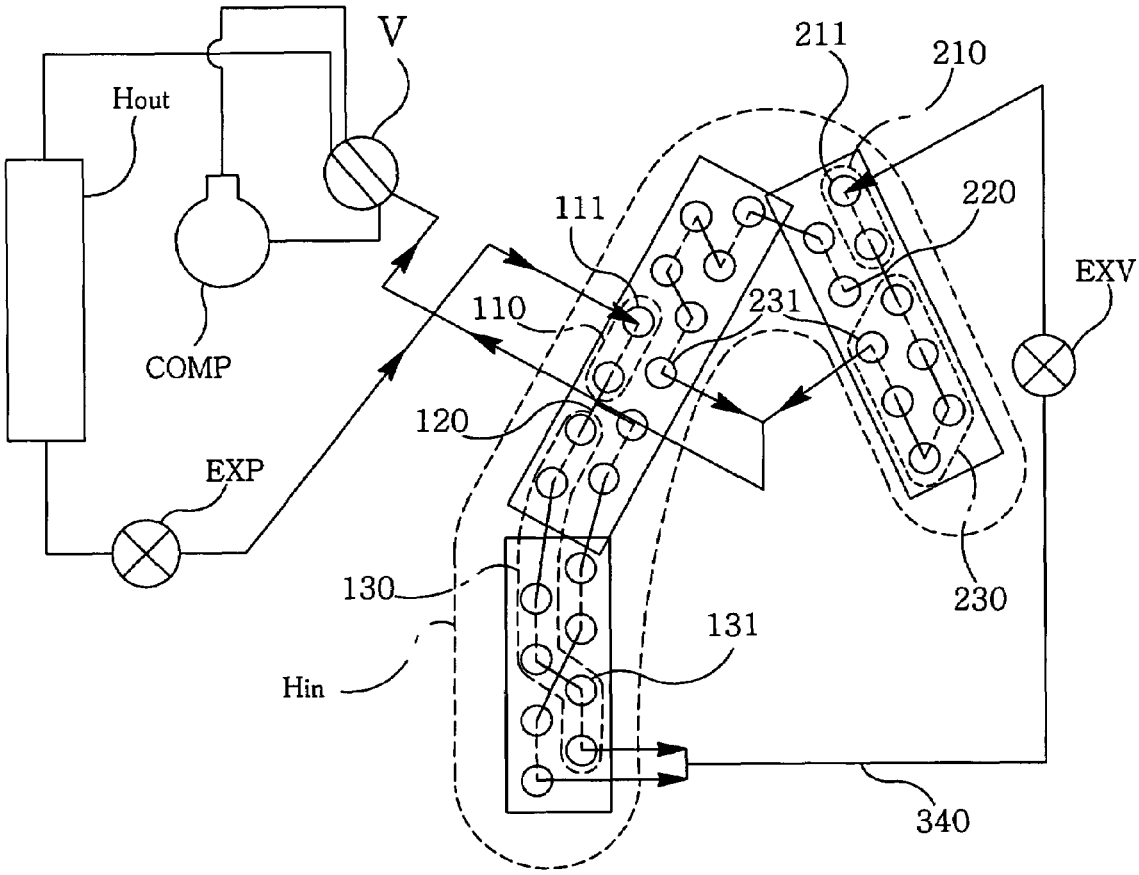
FIG. 8 is a constitutional drawing of another exemplary use of an embodiment of the present invention.

Referring to FIG. 7, the first and second refrigerant inlets (111. 211) are connected to the expansion device (EXP) via a piping, and the first and second refrigerant outlets (131. 231) are connected to the compressor (COMP) via a piping.

In other words, the piping connected from the expansion device (EXP) to the indoor heat exchanger (Hin) is disposed in plurality. To be more specific, one piping is connected to the first refrigerant inlet (111), the other piping is connected to the second refrigerant inlet (211). The pair of first refrigerant outlets (131) is merged to one piping from outside of the indoor heat exchanger (Hin), and at the same time, the pair of second refrigerant outlets (231) is also merged to one piping from outside of the indoor heat exchanger (Hin) such that the merged piping of the first refrigerant outlets (131) and the merged piping of the second refrigerant outlets (231) are again merged to one piping and connected to the expansion device (EXP).

Now, refrigerant flow in the structure thus described will be explained under the cooling operation mode.

The high temperature/pressure refrigerant coming from the compressor (COMP) is introduced into the outdoor heat exchanger (Hout) and the expansion device (EXP) via the four-way valve (V) to be supplied to the first and second refrigerant inlets (111.211). The refrigerant introduced into the first and second refrigerant inlets (111.211) passes the first and second inlet heat exchanging parts (110. 210) to flow into the first and second branch pipes (120.220). The refrigerant having flown into the first branch pipe (120) is distributed into the pair of the first branched heat exchanging parts (130), and the refrigerant having passed the pair of the first branched heat exchanging parts (130) passes the two first refrigerant outlets (131) to be discharged to the outside, and the refrigerant having introduced into the second branch pipe (220) is distributed into the pair of second branched heat exchanging parts (230). The refrigerant having passed the respective second branch heat exchanging parts (230) passes the two second refrigerant outlets (231) and is discharged to the outside. The refrigerant having passed the first and second refrigerant outlets (131.231) is merged into one piping and again sent to the compressor (COMP) to form an indoor-side circulation cooling cycle.

At this time, the indoor heat exchanger (Hin) functions as an evaporator and the outdoor heat exchanger (Hout) functions as a condenser to cool the indoor side. In the present embodiment of the invention, the number of the refrigerant inlet is smaller than that of the refrigerant outlets based on the cooling operation mode, and alternatively the refrigerant flows in the reverse direction based on the heating operation mode such that the number of the refrigerant outlets is larger than that of the refrigerant inlets based on the heating operation mode.

The indoor heat exchanger (Hin) operates as a condenser during the heating operation mode such that the number of the refrigerant outlets is smaller that that of the refrigerant inlets, and an over-cooling region is generated in the first and second branch pipes (120. 220) to increase the overall over-cooling region, which leads to an increase of refrigerant and an approximation of refrigerant quantity during the cooling and heating operation modes, thereby enabling to carry out the cooling and heating operation modes.

Now, referring to FIG.8, another connection state of the indoor heat exchanger (Hin) according to the embodiment of the present invention will be explained.

The first refrigerant inlet (111) is connected to the expansion device (EXP), the first refrigerant outlet (131) is connected to the second refrigerant inlet (211), and the second refrigerant outlet (231) is connected to the compressor (COMP). The expansion valve (EXV) is disposed on an inner piping (340) for connecting the first refrigerant outlet (131) of the first heat exchanging part (100) to the second refrigerant inlet (211) of the second heat exchanging part (200).

The expansion valve (EXV) which is an electronic expansion valve adjusts the degree of openness so that the condensation heat of the first heat exchanging part and the evaporation heat of the second heat exchanging part can match, whereby a dehumidifying operation of dehumidifying the humidity formed on the surface of the indoor heat exchanger (Hin) can be possible during the cooling operation mode.

The first refrigerant inlet (111) is connected to a piping of the expansion device (EXP), and the pair of the first refrigerant outlets (131) is merged to one from outside of the indoor heat exchanger (Hin) to pass the expansion valve (EXV) and to be introduced into the second refrigerant inlet (211). The pair of second refrigerant outlets is merged to one from outside of the indoor heat exchanger (Hin) to be connected to the compressor (COMP).

Now, a refrigerant flow will be described in the structure thus explained during the cooling operation mode.

The high temperature/pressure refrigerant coming from the compressor (COMP) is introduced into the outdoor heat exchanger (Hout) and the expansion device (EXP) via the four-way valve (V) to be supplied to the first refrigerant inlet (111).The refrigerant infused into the first refrigerant inlet (111) passes the first inlet heat exchanging part (110) to be introduced into the first branch pipe (120). The refrigerant infused into the first branch pipe (120) is distributed to the first pair of branched heat exchanging part (130) to pass the expansion valve (EXV) and is introduced into the second refrigerant inlet (211) of the second inlet heat exchanging part (210). The refrigerant introduced into the second refrigerant inlet (211) passes the second inlet heat exchanging part (210) to be infused into the second branch pipe (220). The refrigerant introduced into the second branch pipe (220) is distributed into the second pair of branched heat exchanging parts (230), and the refrigerant that has passed the second branched heat exchanging parts (230) goes through the second refrigerant outlets (231) to be discharged outside. The refrigerant having passed the second refrigerant outlets (231) is collected into one piping and proceeds into the compressor (COMP).

In the present embodiment, the number of refrigerant outlets is greater than that of the refrigerant inlets in terms of cooling operation mode, and in terms of heating operation mode, the number of refrigerant outlets is smaller than that of the refrigerant inlets such that a cooling region is generated at the first branch pipe (120) and the second branch pipe (220) during the cooling operation mode to increase the overall over-cooling region, which leads to an increase of refrigerant and an approximation of refrigerant quantity during the cooling and heating operation modes, thereby enabling to carry out the cooling and heating operation modes.

The following Table 1 shows a comparison of openness of the electronic expansion valve during the cooling and heating operation modes according to the embodiment of the present invention via an exemplary use.

TABLE 1

| | Cooling operation mode | Heating operation mode |
|---|---|---|
| Refrigerant quantity (g) | 930 | 930 |
| Electronic expansion valve openness (pulse) | 158 | 163 |
| Capacity (Btu/h) | 12,197 | 13,000 |
| COP (W/W) | 2.98 | 3.38 |

Figure 9:
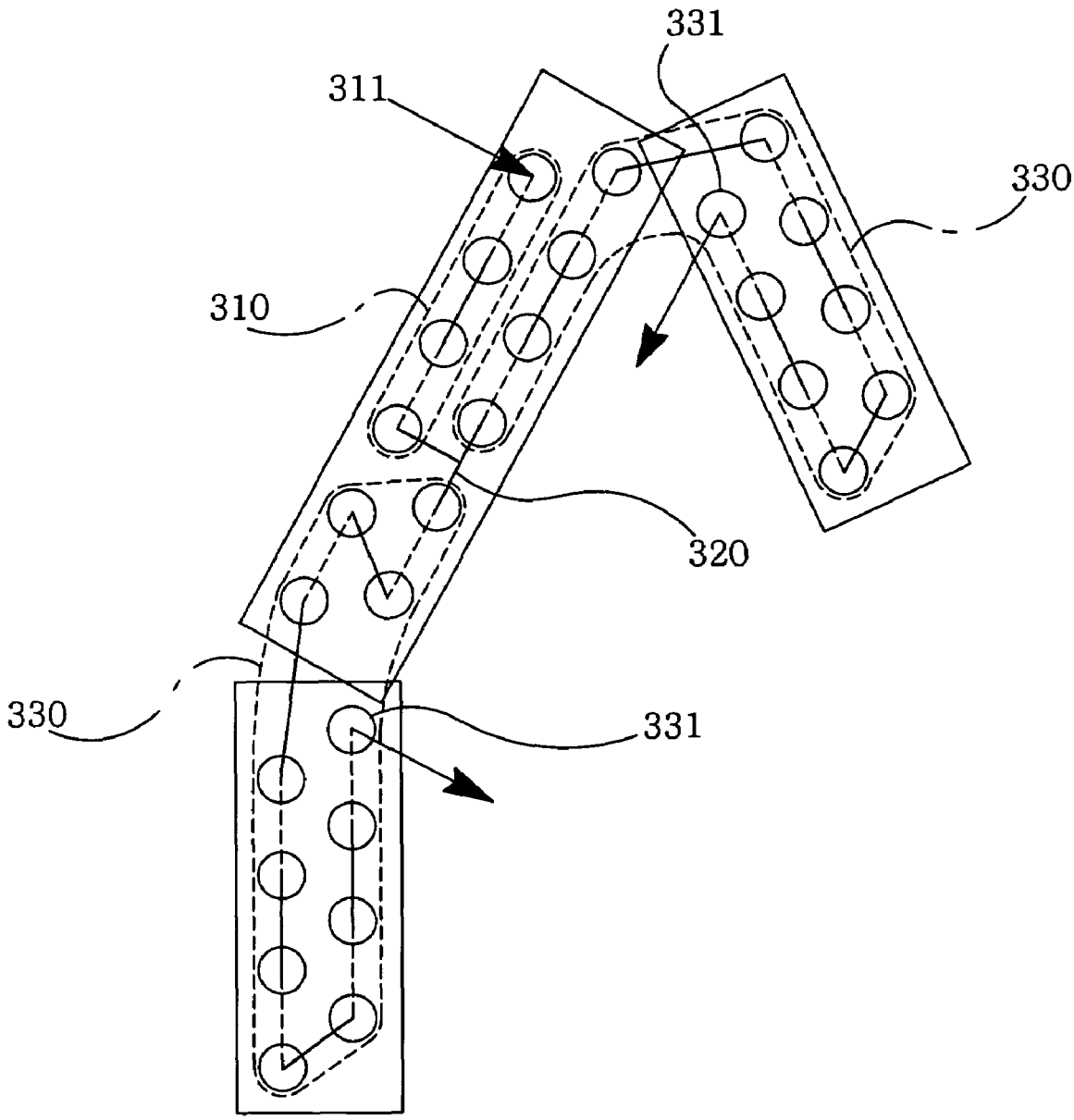
FIG. 9 is a schematic drawing of another embodiment of a heat exchanger of an air conditioner according to the present invention.

Now, an indoor heat exchanger (Hin) of an air conditioner according to another embodiment of the present invention will be described with reference to FIGS. 9 and 10.

The indoor heat exchanger (Hin) according to another embodiment of the present invention includes an inlet heat exchanging part (310) disposed with one refrigerant inlet (311), one branch pipe (320) connected to the inlet heat exchanging part (300) and for distributing the refrigerant during cooling operation mode and concentrating the refrigerant during the heating operation mode, and a pair of first branched heat exchanging parts (330) respectively connected at one end thereof to one side of the branch pipe (320) and connected at the other end thereof to a refrigerant outlet (331).

The pair of branched heat exchanging parts (330) is connected in parallel to one side of the branch pipe (320). The refrigerant inlet (311) is singularly disposed at a distal end of the inlet heat exchanging part (300), and each refrigerant outlet (331) is disposed at the pair of branch heat exchanging part (330) such that the number of refrigerant outlets is totally 2. In other words, the number of refrigerant outlets is greater than that of the refrigerant inlets.

Figure 10:
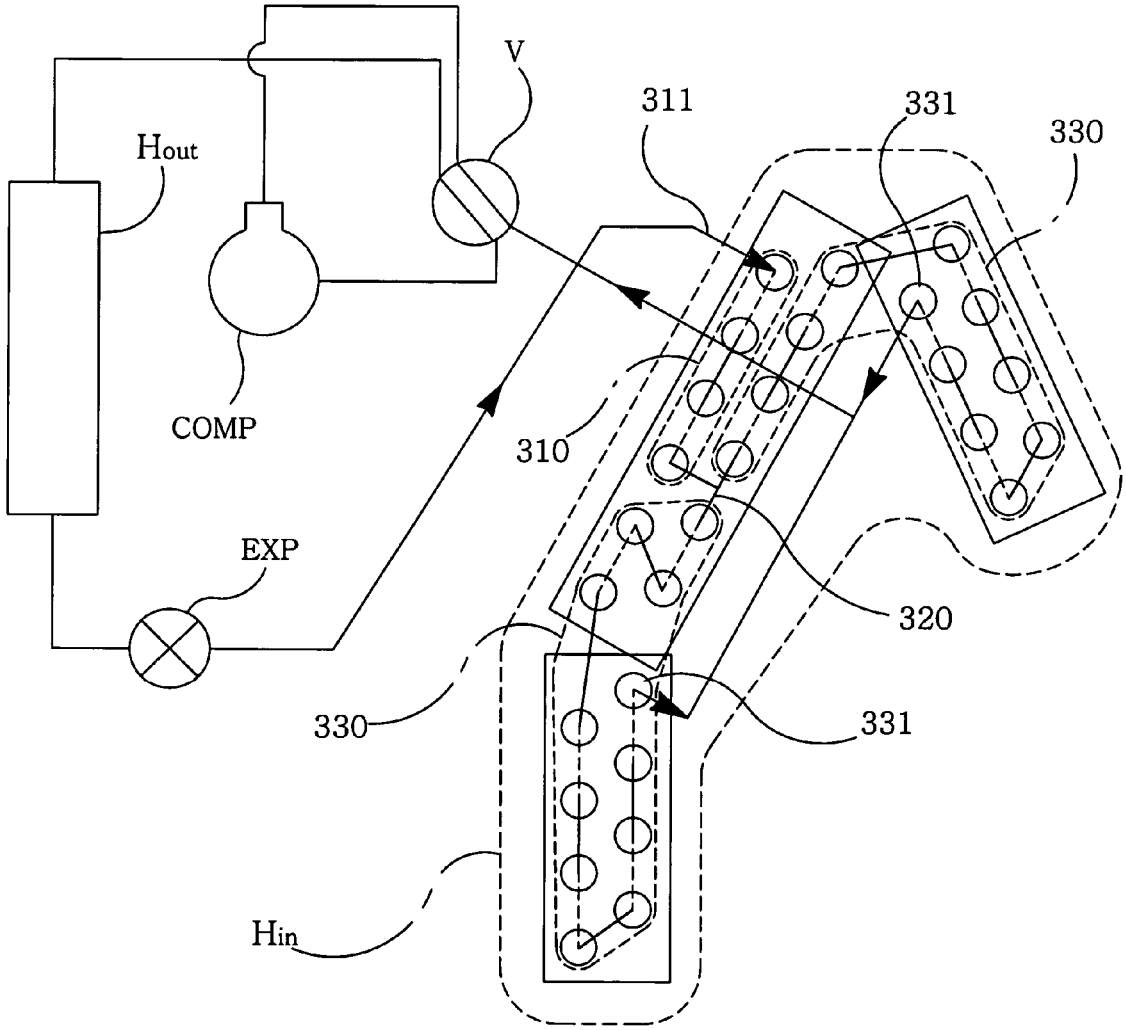
FIG. 10 is an exemplary use of another embodiment according to the present invention.

Referring to FIG. 10, the refrigerant inlet (311) is connected to an expansion device (EXP) via a piping and the pair of refrigerant outlets (331) is connected to a compressor (COMP).

In other words, the piping connected from the expansion device (EXP) to the indoor heat exchanger (Hin) is connected to the refrigerant inlet (311) and the pair of refrigerant outlets (331) is merged to one piping from outside of the indoor heat exchanger and is connected to the compressor (COMP).

Now, a refrigerant flow will be described in the heat exchanger thus constructed during the cooling operation mode.

The high temperature/pressure refrigerant coming from the compressor (COMP) is infused into the outdoor heat exchanger (Hout) and the expansion device (EXP) via the four-way valve (V) and is supplied to the refrigerant inlet (311). The refrigerant introduced into the refrigerant inlet (311) is in turn infused into the branch pipe (320) after passing the inlet heat exchanging part (300). The refrigerant having been introduced into the branch pipe (320) is distributed into the pair of branched heat exchanging parts (330) which in turn passes two refrigerant outlets (331). The refrigerant having passed the pair of refrigerant outlets (331) is merged into one piping and is again sent to the compressor (COMP) to form a cooling cycle for cooling the inside.

Even in the embodiment thus constructed, the number of refrigerant outlets is greater than that of the refrigerant inlets in terms of cooling operation mode, and in terms of heating operation mode, the number of refrigerant outlets is smaller than that of the refrigerant inlets such that a cooling region is generated at the branch pipe (320) and the second branch pipe (220) during the cooling operation mode to increase the overall over-cooling region, which leads to an increase of refrigerant and an approximation of refrigerant quantity during the cooling and heating operation modes, thereby enabling to carry out the cooling and heating operation modes.

As apparent from the foregoing, there is an advantage in the heat exchanger of an air conditioner thus described according to the present invention in that based on the heating operation mode, the number of refrigerant outlets is greater than that of the refrigerant inlets to allow. an over-cooling region to be generated during the heating operation mode, which leads to an approximation of refrigerant quantity during the cooling and heating operation modes, thereby enabling to carry out the cooling and heating operation modes with a singular expansion device. There is another advantage in that because of the construction thus described, same performances can be achieved for both the cooling and heating purposes albeit the heat exchanger being simplified in the structure thereof. There is still another advantage in that manufacturing cost can be reduced to thereby improve the productivity.

What is claimed is:

1. A heat exchanger of an air conditioner comprising:

at least one refrigerant inlet for connecting a compressor for compressing refrigerant to an expansion device for expanding condensed refrigerant via a piping and for receiving high temperature/pressure refrigerant coming from the expansion device during a cooling mode; and a plurality of refrigerant outlets for discharging the refrigerant to the compressor, wherein the number of the refrigerant outlets is greater than that of the at least one refrigerant inlet.

2. The heat exchanger as defined in claim 1, further comprising:

an inlet heat exchanging part having the at least one refrigerant inlet;

at least one branch pipe each connected to the at least one refrigerant inlet of the inlet heat exchanging parts for distributing the refrigerant during a cooling operation mode and for concentrating the refrigerant during a heating operation mode; and a plurality of branched heat exchanging parts, each one end thereof connected to one end of the at least one branch pipe and each other end thereof formed with the refrigerant outlet.

3. The heat exchanger as defined in claim 2, wherein the branch pipe is a T-shaped three-way pipe, one end of which is connected to the inlet heat exchanging part and remaining two ends of which are connected to two branched heat exchanging parts.

4. The heat exchanger as defined in claim 2, wherein the at least one refrigerant inlet is connected to the expansion device and the refrigerant outlets are connected to the compressor.

5. The heat exchanger as defined in claim 3, wherein the at least one refrigerant inlet is connected to the expansion device and the refrigerant outlets are connected to the compressor.

6. The heat exchanger as defined in claim 2, comprising:

a first heat exchanging part; and a second heat exchanging part, each part further comprising: a singular inlet heat exchanging part, a singular branch pipe and two branched heat exchanging parts, wherein a refrigerant inlet of the first heat exchanging part and a refrigerant inlet of the second heat exchanging part are connected to the expansion device, and a refrigerant outlet of the first heat exchanging part and a refrigerant outlet of the second heat exchanging part are connected to the compressor.

7. The heat exchanger as defined in claim 3, comprising:

a first heat exchanging part; and a second heat exchanging part, each part further comprising: a singular inlet heat exchanging part, a singular branch pipe and two branched heat exchanging parts, wherein a refrigerant inlet of the first heat exchanging part and a refrigerant inlet of the second heat exchanging part are connected to the expansion device, and a refrigerant outlet of the first heat exchanging part and a refrigerant outlet of the second heat exchanging part are connected to the compressor.

8. The heat exchanger as defined in claim 2, comprising:

a first heat exchanging part; and a second heat exchanging part, each part further comprising: a singular inlet heat exchanging part, a singular branch pipe and two branched heat exchanging parts, wherein a refrigerant inlet of the first heat exchanging part is connected to the expansion device, the refrigerant outlet of the first heat exchanging part is connected to the refrigerant inlet of the second heat exchanging part, and the refrigerant outlet of the second heat exchanging part is connected to the compressor.

9. The heat exchanger as defined in claim 8, further comprising an expansion valve disposed on a connection passage for connecting the refrigerant outlet of the first heat exchanging part and the refrigerant inlet of the second heat exchanging part, and for adjusting an openness so that condensation heat of the first heat exchanging part and evaporation heat of the second heat exchanging part can match during a constant temperature dehumidifying operation.

10. The heat exchanger as defined in claim 2, comprising:

a first heat exchanging part; and a second heat exchanging part, each part further comprising: a singular inlet heat exchanging part, a singular branch pipe and two branched heat exchanging parts, wherein a refrigerant inlet of the first heat exchanging part is connected to the expansion device, the refrigerant outlet of the first heat exchanging part is connected to the refrigerant inlet of the second heat exchanging part, and the refrigerant outlet of the second heat exchanging part is connected to the compressor.

11. The heat exchanger as defined in claim 10, further comprising an expansion valve disposed on a connection passage for connecting the refrigerant outlet of the first heat exchanging part and the refrigerant inlet of the second heat exchanging part, and for adjusting an openness so that condensation heat of the first heat exchanging part and evaporation heat of the second heat exchanging part can match during a constant temperature dehumidifying operation.

* * * * *